US006269978B1

(12) United States Patent
Sindoni

(10) Patent No.: US 6,269,978 B1
(45) Date of Patent: Aug. 7, 2001

(54) DISPENSING AND DOSING MACHINE FOR DYESTUFFS

(75) Inventor: Giuseppe Sindoni, Milan (IT)

(73) Assignee: Italtinto S.r.l., Carasco (IT)

( * ) Notice: Subject to any disclaimer, the term of this patent is extended or adjusted under 35 U.S.C. 154(b) by 0 days.

(21) Appl. No.: 09/603,926

(22) Filed: Jun. 27, 2000

(30) Foreign Application Priority Data

Jul. 16, 1999 (IT) ..... MI990460 U

(51) Int. Cl.[7] ..... B67D 5/60
(52) U.S. Cl. ..... 222/144.5; 222/148; 222/485
(58) Field of Search ..... 222/144, 145, 222/148, 136, 333, 386, 485

(56) References Cited

U.S. PATENT DOCUMENTS 4,582,231 * 4/1986 Warning, Jr. ..... 222/144
4,681,741 * 7/1987 Hanaway ..... 222/144
5,911,342 * 6/1999 Sindoni ..... 222/144
5,938,080 * 8/1999 Haaser et al. ..... 222/144

* cited by examiner

*Primary Examiner*—Philippe Derakshani
*Assistant Examiner*—Thach H Bui
(74) *Attorney, Agent, or Firm*—Young & Thompson

(57) ABSTRACT

A dispensing and dosing machine for dyestuffs includes pins having the same diameter as ducts wherein which the pins are located, the pins acting to both dispenses dyestuffs and clean the walls of the ducts.

8 Claims, 3 Drawing Sheets

DISPENSING AND DOSING MACHINE FOR DYESTUFFS

BACKGROUND OF THE INVENTION

This invention proposes a dispensing and dosing machine for dyestuffs, paints and the like, equipped with a central unit for simultaneous dispensing of one or more dyestuffs or viscous liquids and a nozzle cleaning system composed of a multiple number of axially sliding pins, moved by a stepwise motor and inserted into the dispensing nozzles from above so as to ensure a complete discharge of the dyestuff and form a seal preventing the liquid in the channels from drying out.

DESCRIPTION OF THE RELATED ART

A number of devices for dispensing and dosing dyestuffs are known, which comprise a multiple number of tanks holding a different dyestuff base each, and dispensing devices capable of dispensing a predetermined quantity of dyestuff. Some electronic systems control these dispensing devices so that each of them supplies the quantity of dyestuff needed to achieve the require tinting after being mixed.

Modern dyestuffs are prepared by mixing a certain quantity of dyestuff base such as for instance white or gray with a small percentage of one or more dyestuffs, in a combination designed to achieve the final tinting required.

These dyestuffs are employed in extremely limited quantities, often just a few drops, which means that a plugging in one or more of the dispensing channels affects the quantity of the discharged material and therefore the final tinting of the product.

Some dosing machines are already known, such as for instance those described in the U.S. Pat. Nos. 4,314,653 and 5,042,699 by the same Applicant.

The patent application of the Italian utility model no. MI96U 0105 describes a dyestuff dispensing machine comprising a multiple number of dyestuff tanks arranged in a radial pattern around a central dispensing head equipped on its lateral wall with a multiple number of radial fittings for connecting to as many supply tanks, and on the bottom wall a discharge outlet connected to said fittings by passages provided inside the head.

The U.S. Pat. No. 5,449,028 describes a dyestuff dispensing device of a type comprising a multiple number of dispensing channels, each connected to a tank and arranged so as to discharge the dyestuff through some nozzles set in the lower wall, which provides for a removable lid for the sealing of said lower wall, shaped in a way to form a tightly sealed chamber surrounding the area for discharging the channels.

This sealing lid has been provided to limit the nozzles' contact with air, in an attempt to prevent or at least retard the drying out of the product left over in the discharge channels.

The dyestuff pastes of a water base or other kind in fact have an extremely limited drying time which is a considerable source of drawbacks, as some plugs of dried-out liquid form inside the dispensing channels and to affect the dispensing process.

This makes it necessary to ensure a rigorous cleanliness of the dispensing channels.

The known systems described above, in particular that of the U.S. Pat. No. 5,449,028 have been developed precisely in the attempt of limiting this drying-out phenomenon.

Despite the fact that appreciable results have been achieved, the problem is still not entirely solved, as even with the use of a sealing lid the dyestuff is still left behind in the channels, and if the machine is left standing for a certain period of time, dries out and re-proposes the problem.

SUMMARY OF THE INVENTION

A solution of this problem is now offered by this invention, which proposes a dispensing and dosing machine of a type comprising a multiple number of tanks directing the dyestuff toward a central dispensing head equipped with dispensing channels, a machine fitted with a number of pins coaxial with the terminal portion of the discharge channels and having the same diameter of the latter, which are inserted into these channels from the top so as to evacuate them completely and simultaneously achieve a tight seal.

This solution thus allows on one hand a complete discharge of the dyestuff without risking their partial entrapment in the channels, and on the other hand prevents the drying out of the material, due to the fact that these pins achieve a perfect seal on the entire surface of the dispensing channels.

BRIEF DESCRIPTION OF THE DRAWINGS

This innovation will now be described in detail, for exemplifying but not limiting purposes, with reference to the enclosed figures in which.

DESCRIPTION OF THE PREFERRED EMBODIMENT

Figure 1:
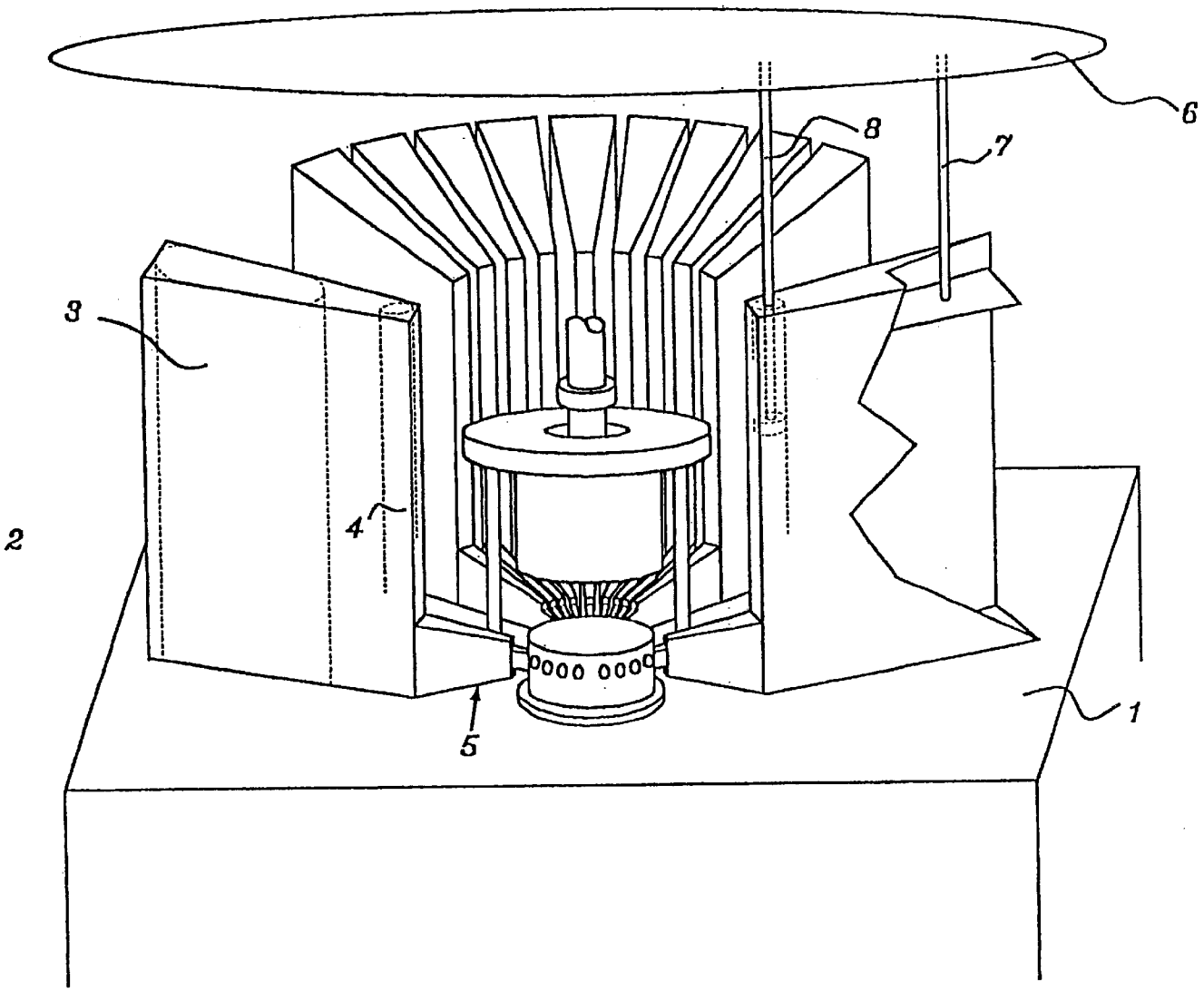
FIG. 1 describes the machine of the invention in a simplified overall form.
Figure 2:
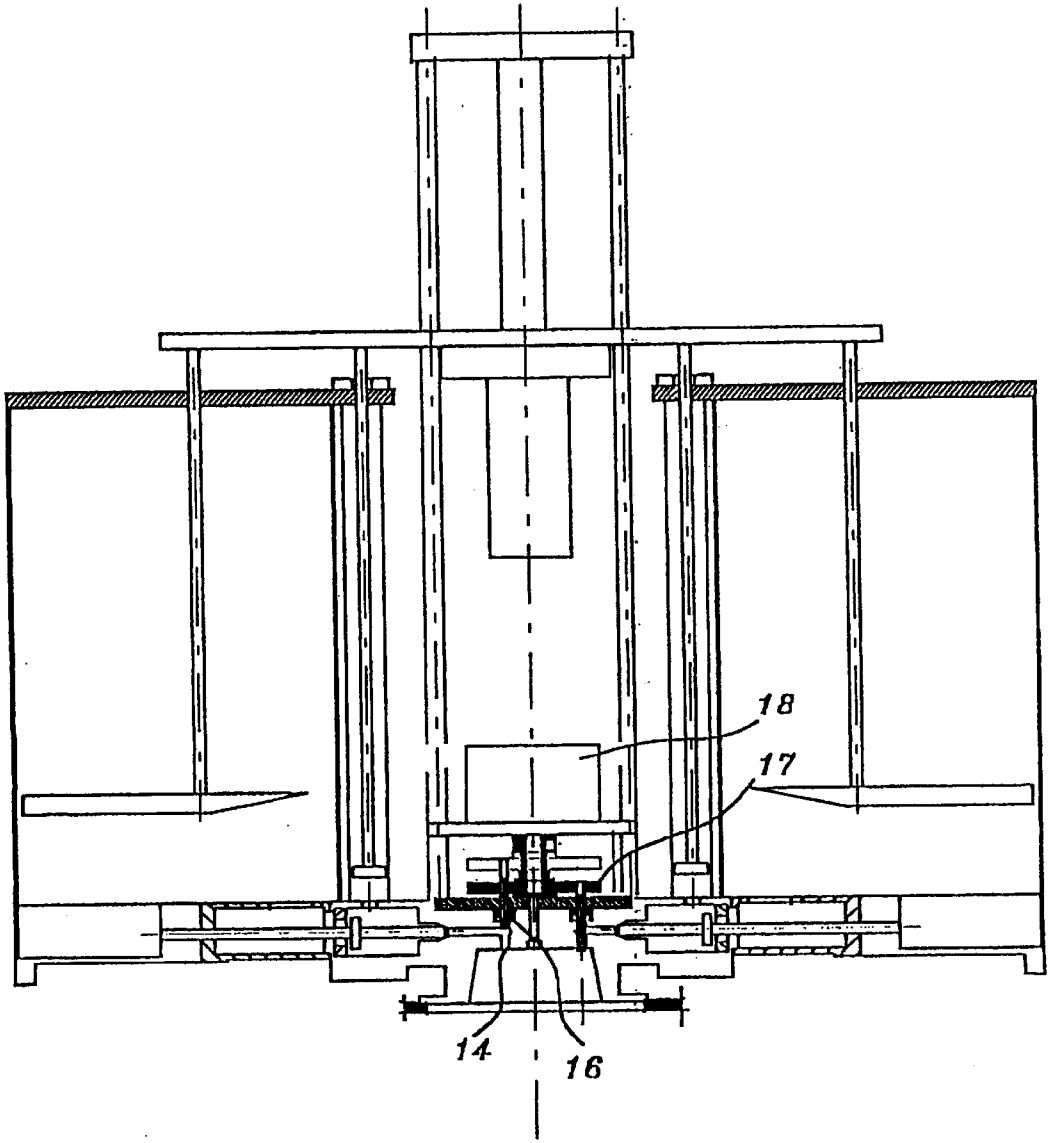
FIG. 2 is a simplified assembled view of the tanks and of the dispensing units.

With reference to the FIGS. 1 and 2, the number 1 indicates the foundation of a machine mounting a multiple number of radially arranged units 2, each comprising a tank 3 for the dyestuff, a dosing pump 4 and a dispensing complex 5.

A platelet 6 is set above the dispensing and dosing units, attached to a multiple number of stems 7 respectively connected to blades designed to remove the dyestuff from the tanks which aspirate a certain amount of dyestuff from these tanks and direct it toward the dispensing devices 8.

Figure 3:
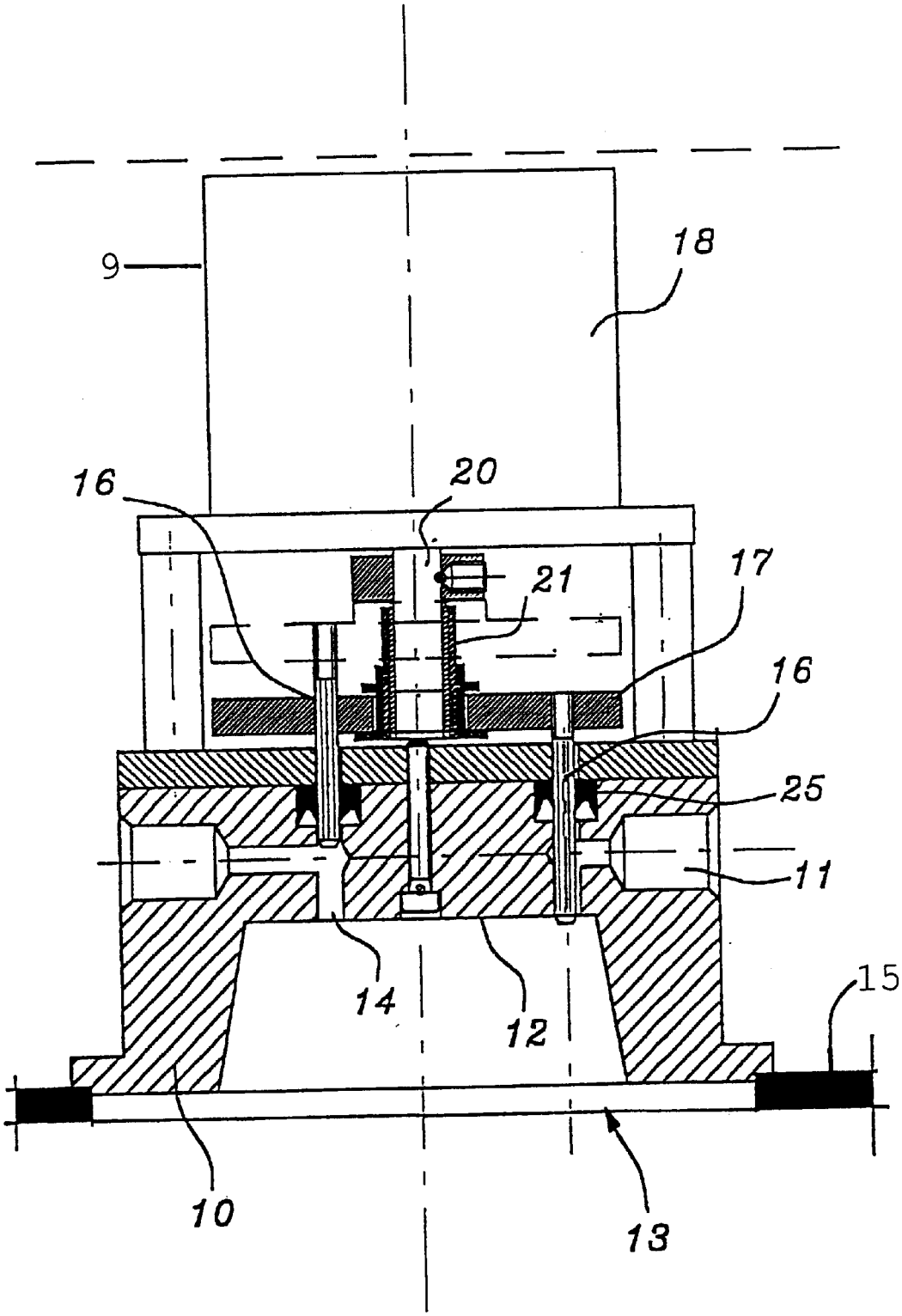
FIG. 3 is a cross-section of the dispensing unit equipped with the cleaning system according to the invention.

The latter are connected to a central discharging head, indicated in its overall form by the number 9 and illustrated in a vertical cross-section in FIG. 3.

The number 10 indicates the body of the dispensing head, which exhibits a number of joints 11 for connecting to the dispensing devices on its lateral sides, and on the lower wall 12 of a discharge outlet 13, a series of discharge channels connected to said joints 11.

The dispensing devices pick up the dyestuff from the tanks and pump it to the joints 11, which discharge it through the channels 14 so a to drop it into an underlying vessel.

The number 15 indicates the structure of the machine mounting the dispensing head.

A characteristic of the innovation is to provide a series of pin-type elements 11, one for each dispensing channel 14, attached to a disc 17 set on top of the dispensing head and actuated by a step-wise motor 18 so as to move in an alternating motion in an essentially vertical direction.

The pins 16 have the same diameter of the channels 14 and are coaxial with the same.

The shaft 20 of the motor 18 is threaded and engages with a bushing 21 which is firmly attached to the pin supporting disc 17.

The run of the pin supporting disc 17 is such as to take the latter from a raised position shown on the left side of FIG. 3, in which the pins release the dispensing channels 14 thus allowing them to communicate with the joints 11, to a lowered position shown on the right side of the same FIG. 3, in which the pins fit entirely into the channels 14, up to the point of reaching the lower wall 12 of the discharge outlet 13.

This descending motion of the pins leads to fully expelling the dyestuff and to simultaneously cleaning up the walls of the channels.

The pins' terminal portion will preferably be pointed so as to favor the detachment of even minimal quantities of dyestuff.

Moreover, each pin will preferably provide some annular gaskets 25, for instance of a lip-type, capable of ensuring a good seal and performing the function of perfectly cleaning the surface of the pin, whenever the latter is raised.

The operation is as follows.

When the product is to be dosed, the operator sets the quantity and type of the required dyestuff, by acting on certain electronic control devices of the machine. The control determines the quantity of each dyestuff to be dispensed, and actuates is the motor 18 to command the lifting of the disc 17 up to the point of moving the pins 16 above the passage connecting the channel 14 with the joints 11 (FIG. 3 to the left).

At this point the dosing devices dispense the required quantity of each dyestuff according to a known technology, by discharging it from the outlet 13 through the channels 14.

Once the dosage has been completed, the control switches the motor 18 with the pins 16 to a reverse rotating motion, so that each of the pins penetrates into its respective channel 14.

During this motion the pins, whose diameter is exactly the same as the internal diameter of the channels, totally expel the residual dyestuff and clean up the walls.

Once the disc 17 with the pins 16 has terminated its descent, all channels remain perfectly closed and sealed, without affording the dyestuff any chance to come in contact with the air and thus to dry up.

This has produced a device for the simultaneous dispensing of dyestuffs, equipped with a central self-cleaning dispenser capable of avoiding all drawbacks due to the drying-out of the material in the dispensing channels, typical of the known art. An expert in the trade may further provide for various executions of the same concept, all of which are however to be held as falling within the scope of this invention.

What is claimed is:

1. A dispensing and dosing machine for dyestuffs, comprising:

plural dispensing devices;

a dyestuffs discharge outlet;

a dispensing head fitted with dispensing channels, the dispensing channels having an internal cylindrical surface, a first end connected to one of the dispensing devices and a second discharge end at a common volume in communication with the dyestuffs discharge outlet;

a pin inserted in each of the dispensing channels, the pins sized to have an outside diameter equal to an inside diameter of the internal cylindrical surface of the corresponding dispensing channel; and a movement means for fitting each pin into a terminal portion of the corresponding dispensing channel so as to fully expel dyestuffs within the dispensing channel and clean the internal cylindrical surface of residual dyestuff.

2. A dispensing and dosing machine for dyestuffs, comprising:

plural dispensing devices;

a dyestuffs discharge outlet;

a dispensing head located intermediate the dispensing devices and the dyestuffs discharge outlet;

plural dispensing channels located within the dispensing head, each of the plural dispensing channels having an internal cylindrical surface and two cylindrical ends, a first cylindrical end being a discharge end in communication with the dyestuffs discharge outlet;

a pin inserted into a second of the cylindrical ends and arranged to move within the internal cylindrical surface to discharge dyestuffs into the dyestuffs discharge outlet, the pin sized to have an outside diameter equal to an inside diameter of the internal cylindrical surface of the dispensing channel;

a dispensing device channel within the dispensing head and configured to connect, at a first end, to one of the dispensing devices, and, at a second end, to a port within an associated dispensing channel, the port being penetrating the internal cylindrical surface intermediate the two cylindrical ends; and a pin movement means for moving each pin through an entire length of the internal cylindrical surface of the corresponding dispensing channel so as to fully expel dyestuffs from within the dispensing channel and to clean the entire length of the internal cylindrical surface of residual dyestuff.

3. The dispensing machine of claim 2, wherein each dispensing device channel is horizontally oriented and the internal cylindrical surface of the dispensing channels is vertically oriented.

4. The dispensing machine of claim 3, wherein said pin movement means comprises a mobile platelet operatively connected to each of the pins so as to move each pin between a first position in which each pin is lifted up to a point of positioning to open said port and a second position in which a lower extremity of each pin is brought flush with the discharge end of the corresponding dispensing channel.

5. The dispensing machine of claim 3, wherein, the pins have a beveled lower extremity with beveled sides and an adjoining flat end surface, and the pin movement means moves the pins between a first position in which each pin is lifted up to a point of positioning to open said port and a second position in which the beveled sides are brought into the dye discharge outlet.

6. The dispensing machine of claim 4, further comprising:

a stepwise moving motor; and a threaded shaft engaging the motor and connected to the platelet to move the platelet.

7. The dispensing machine of claim 2, wherein the dispensing head includes a cylindrical outer case and the dispensing devices are attached to the dispensing head via external ports located around an external cylindrical surface of the outer case.

8. A dispensing and dosing machine for dye-stuffs, comprising:

a foundation;

a discharging head located centrally on the foundation; and plural dispensing devices mounted on the foundation and arranged radially with respect to the discharging head, the discharging head including a dyestuffs discharge outlet, plural dispensing channels discharging to the dyestuffs discharge outlet, the dispensing channels having an internal cylindrical surface, a first end connected to one of the dispensing devices and a second discharge end at a common volume in communication with the dyestuffs discharge outlet, a pin inserted in each of the dispensing channels, the pins sized to have an outside diameter essentially equal to an inside diameter of the internal cylindrical surface of the corresponding dispensing channel; and a movement means for fitting each pin into a terminal portion of the corresponding dispensing channel so as to fully expel dyestuffs within the dispensing channel and to clean the internal cylindrical surface of residual dyestuff.

* * * * *